US007021106B2

(12) United States Patent
Jesson et al.

(10) Patent No.: US 7,021,106 B2
(45) Date of Patent: Apr. 4, 2006

(54) APPARATUS AND METHOD FOR FORMING INTERNALLY RIBBED OR RIFLED TUBES

(75) Inventors: John E. Jesson, West Sussex (GB); Michael J. Smith, Roswell, GA (US)

(73) Assignee: Mitsui Babcock (US) LLC, Atlanta, GA (US)

( * ) Notice: Subject to any disclaimer, the term of this patent is extended or adjusted under 35 U.S.C. 154(b) by 13 days.

(21) Appl. No.: 10/824,651

(22) Filed: Apr. 15, 2004

(65) Prior Publication Data

US 2005/0229667 A1 Oct. 20, 2005

(51) Int. Cl.
*B21C 1/24* (2006.01)

(52) U.S. Cl. ..... 72/283; 72/68; 72/77

(58) Field of Classification Search ..... 72/283, 72/276, 68, 77, 97
See application file for complete search history.

(56) References Cited

U.S. PATENT DOCUMENTS

| | | | | |
|---|---|---|---|---|
| 1,465,073 | A | 8/1923 | Davis | |
| 2,358,833 | A | 9/1944 | Wadell | |
| 2,852,835 | A | 9/1958 | Harvey et al. | |
| 3,088,494 | A | 5/1963 | Koch et al. | |
| 3,213,525 | A | 10/1965 | Creighton et al. | |
| 3,289,451 | A | 12/1966 | Koch et al. | |
| 3,292,408 | A | 12/1966 | Hill | |
| 3,768,291 | A | 10/1973 | Rieger | |
| 4,733,698 | A | 3/1988 | Sato | |
| 4,847,989 | A | 7/1989 | Franks | |
| 4,854,148 | A | 8/1989 | Mayer | |
| 4,866,830 | A | 9/1989 | Zohler | |
| 4,876,869 | A | 10/1989 | Saeki et al. | |
| 4,921,042 | A | 5/1990 | Zohler | |
| 4,938,282 | A | 7/1990 | Zohler | |
| 4,942,751 | A | 7/1990 | Fuchs, Jr. | |
| 5,010,643 | A | 4/1991 | Zohler | |
| 5,662,070 | A | 9/1997 | Kastner et al. | |
| 5,690,167 | A | 11/1997 | Rieger | |
| 5,735,236 | A | 4/1998 | Kastner et al. | |
| 5,881,592 | A * | 3/1999 | Blackwell et al. | 72/283 |
| 5,967,097 | A | 10/1999 | Kastner et al. | |
| 6,250,257 | B1 | 6/2001 | Kastner et al. | |
| 6,302,194 | B1 | 10/2001 | Kastner et al. | |
| 6,488,078 | B1 | 12/2002 | Beutler et al. | |
| 2003/0094272 | A1 | 5/2003 | Brand et al. | |

FOREIGN PATENT DOCUMENTS

| | | | | |
|---|---|---|---|---|
| EP | 0 581 760 B2 | | 10/2001 | |
| JP | 61-140319 | * | 6/1986 | 72/283 |
| JP | 62-107814 | * | 5/1987 | 72/283 |

* cited by examiner

*Primary Examiner*—Daniel C. Crane

(57) ABSTRACT

A plug tool for forming internally helically ribbed tube comprises a plug body for being rotatably disposed in a die orifice of a drawing die. The plug body has a central longitudinal axis, a plurality of external grooves equally spaced about the axis and a plurality of external lands in alternating arrangement with the grooves. The grooves extend along the plug body at a helix angle to the axis. Each groove has a normal cross-section defined by a root surface and opposing flank surfaces extending angularly outwardly from the root surface to adjacent land surfaces. The flank surfaces extend angularly outwardly from the root surface in opposite directions at different angles from one another. A method for forming internally helically ribbed tube involves drawing a length of tubing over the plug body rotatably disposed in a die orifice of a drawing die and constricting the tubing in the drawing die to force the tubing into the grooves of the plug body to form a plurality of internal helical ribs in the tubing in correspondence to the grooves.

45 Claims, 5 Drawing Sheets

APPARATUS AND METHOD FOR FORMING INTERNALLY RIBBED OR RIFLED TUBES

BACKGROUND OF THE INVENTION

1. Field of the Invention

The present invention relates generally to the formation of internally ribbed or rifled tubes and, more particularly, to plug tools for forming internal helical or spiral ribs in tubing, and to methods of producing internally helically or spirally ribbed or rifled tubes.

2. Brief Discussion of the Related Art

Internally ribbed or rifled tubes are used for various heat transfer or heat exchange applications including steam generating and superheating equipment such as boilers. Internally ribbed or rifled tubes present various advantages over plain bore tubes including the ability to sustain high heat transfer rates at higher pressures, higher enthalpies and lower mass fluxes than plain bore tubes.

The advantage of using internally ribbed or rifled tubes in furnaces of boilers was recognized during the development of steam boilers. Initially, however, internally ribbed tubes were lap-welded tubes. Eventually, it was proposed to produce seamless internally ribbed tubes for boiler applications as represented by U.S. Pat. No. 1,465,073 to Davis. The Davis patent referred to the internal ribs as increasing the heating surface and the effectiveness of heat transfer to water and steam inside the tubes. The use of internally ribbed tubes was still limited because the benefit derived from the internally ribbed tubes was not as great in many boiling ranges with certain arrangements and dimensions of the ribs.

In a boiler there are two known types of boiling that can occur: nucleate and film. In nucleate boiling, steam bubbles are formed and released on the inside surface of a tube with water wetting the inside surface, whereas in film boiling the inside surface of the tube is covered by a film of steam. Nucleate boiling creates excellent heat transfer conditions as the steam bubbles generated at nucleation points are rapidly detached from the water and move into and agitate the bulk liquid. In film boiling, heat transfer is hindered by the steam film that prevents water from wetting the inside surface of the tube and absorbing heat. U.S. Pat. No. 3,088,494 to Kotch et al. proposed the theory of increased heat transfer in nucleate boiling through an improved internally ribbed vapor generating tube for sub-critical pressure that promoted the maintenance of nucleate boiling irrespective of the positioning of the tube. U.S. Pat. No. 3,213,525 to Creighton et al., U.S. Pat. No. 3,289,451 to Kotch et al., and U.S. Pat. No. 3,292,408 to Hill relate to apparatus and methods for forming internally ribbed tubes of the type disclosed in the Kotch et al. patent. The phenomenon of the change of heat transfer from nucleate boiling to film boiling is also observed at super-critical pressures even though the physical distinction of the steam bubbles and steam film from water by a clear interface or surface is not present and is replaced by steep density and enthalpy gradients. The deterioration in the heat transfer is generally referred to as the boiling crisis or worsened heat transfer to encompass both sub and supercritical conditions.

Boilers are either natural circulation, assisted circulation or once-through in type. All of these can operate at subcritical steam conditions but only once-through boilers offer the possibility of operation at supercritical steam conditions. Ribbed tubing has been applied over the years in all of these wherever the likelihood of worsened heat transfer is perceived, though, in general, the assisted circulation and once-through technologies do not require it because the tube internal flow rates can be sufficient to maintain high heat transfer rates. Once-through steam generators having internally ribbed tubes forming a vertical gas flue or combustion chamber are disclosed in U.S. Pat. No. 5,662,070, No. 6,735,236, No. 5,967,097, No. 6,250,257 B1 and No. 6,302,194 B1 to Kastner et al, and in European Patent EP 0 581 760 B2.

Ribbed tubing exists in many forms, from the earliest lap welded varieties, through seamless variants such as single lead ribbed tubes and multi-lead rifled tubes. The heat transfer properties of this "standard" ribbed tubing allows the mass flux within the tubes to be reduced when compared to plain bore tubing. To date, however, it has not allowed sufficient reduction to enable a once-through boiler furnace to be cooled successfully in a single vertical pass. The introduction of "optimized" multi-lead rifled tubing with steeper lead angle and taller rib, as represented by Kastner et al ('194), has finally achieved this goal but the manufacturing difficulties have been such that it could not be economically produced in commercial quantities. Small lengths of rifled tubing produced for performance testing purposes do not reveal the range of problems associated with the manufacture of rifled tubing in commercial quantities. The present invention addresses these problems by changes to the tooling and manufacturing processes. Additionally, modifications to the rib profile have reduced manufacturing forces.

Despite advancements in the production of internally ribbed tubes, the majority of once-through boilers in operation today have furnace walls built with plain bore tubes for heat transfer requirements at high mass flux flow density. Although some once-through boilers employ internally ribbed tubes, they are also usually assigned to operate at high mass flux flow density. The Kastner et al patent ('194) discloses internally ribbed tubes designed for use independently of mass flow rate density, thereby allowing higher steam contents and reducing undesired temperature increases in the tube wall. Production of internally ribbed tubes pursuant to the Kastner et al. patent presents fabrication problems such as difficulty in removing the rib-forming tool, the presence of stresses that cause frequent tool breakages, and a very slow rate of production.

Internal helical or spiral ribs may be formed in tubing via a cold drawing process in which the tubing is drawn longitudinally over a plug tool comprising an externally helically or spirally grooved plug disposed in a die orifice of a drawing die. The drawing die constricts the tubing as it is drawn through the die orifice, causing the internal surface or wall of the tubing to be forced into the external grooves of the plug. The plug rotates about its central longitudinal axis within the die orifice as the tubing is drawn through the die orifice over the plug. Accordingly, continuously extending helical or spiral ribs closely corresponding to the external grooves of the plug are formed in the internal wall of the tubing. The plug is typically coupled with a shaft or back-bar of the draw bench, with the tubing being advanced over and along the shaft or back-bar as it enters the die orifice.

In addition to the patents referred to above, illustrative apparatus and methods for forming internal ribbing in tubing are represented by U.S. Pat. No. 2,358,838 to Wadell, U.S. Pat. No. 2,852,835 to Harvey et al., U.S. Pat. No. 3,768,291 to Reiger, U.S. Pat. No. 4,733,698 to Sado, U.S. Pat. No. 4,847,989 to Franks, U.S. Pat. No. 4,854,148 to Mayer, U.S. Pat. No. 4,866,830 to Zoller, U.S. Pat. No. 4,876,869 to Saki et al., U.S. Pat. No. 4,921,042 to Zoller, U.S. Pat. No. 4,938,282 to Zoller, U.S. Pat. No. 4,942,751 to Fuchs, Jr., U.S. Pat. No. 5,010,643 to Zoller, U.S. Pat. No. 5,690,167 to Reiger, U.S. Pat. No. 6,302,194 to Castner et al., and U.S. Pat. No. 6,488,078 to Buetler et al., and by U.S. Patent Application Publication No. US2003/0094272 to Brand et al.

Many prior apparatus and methods for forming internal helical or spiral ribbing in tubes are associated with drawbacks due to the forces imposed on the plug tool during the drawing process leading to relatively short tool life, relatively low productivity and the inability to economically and consistently produce internally helically or spirally ribbed tubes in commercial quantities. Internally helically or spirally ribbed tubes produced using prior apparatus and methods may present deficiencies when used in a vertical arrangement in a once-through boiler including undesirable boiler feed pump power requirements, flow characteristics and furnace temperatures, as well as greater complexity and cost of construction.

SUMMARY OF THE INVENTION

The present invention overcomes the disadvantages of prior apparatus and methods for forming internally helically or spirally ribbed or rifled tubes. The apparatus and method of the present invention increase productivity and prolong tool life in a cold drawing process for forming internal helical or spiral ribs or rifles in tubing. With the present invention, the forces exerted on the plug tool used to form internal helical or spiral ribs or rifles in tubing in a cold drawing process are minimized. The tubing being drawn is squeezed onto the plug as much as the plug tool is forced into the tubing, and minimum force occurs since the width of the grooves in the plug is equal as far as practically possible to the width of the lands between the grooves. The apparatus and method of the present invention allow internally helically or spirally ribbed or rifled tubes to be produced in commercial quantities economically and consistently.

Heat transfer tubes manufactured in accordance with the present invention have an optimized multiple rib configuration advantageous for use in boilers and offering excellent heat transfer characteristics, operating at low mass flux density, adapting to a vertical tube arrangement, and working effectively in both sub-critical and super-critical pressures. Heat transfer tubes manufactured pursuant to the present invention extend high heat transfer rates by maintaining a high density water film in contact with the heat transfer tubes longer at low mass fluxes and high fluid enthalpies. Heat transfer tubes manufactured pursuant to the present invention may be used in a vertical arrangement in a once-through boiler to provide lower pressure loss, reduced boiler feed pump power requirements, positive flow characteristics to suit variable heat fluxes, lower heat rate through sliding pressure operation resulting in power savings, increased boiler continuous output, reduced furnace temperatures thereby minimizing stresses, smaller tube to tube temperature differences, simpler and less expensive construction due to self-supporting furnace walls, the elimination of valves between the furnace and superheater, the elimination of flow balancing valves, and shorter installation times.

The present invention is generally characterized in a plug tool for forming internally helically or spirally ribbed or rifled tubing comprising a plug including a plug body for being rotatably disposed in a die orifice of a drawing die and having a central longitudinal axis, a plurality of external grooves equally spaced about the central longitudinal axis and a plurality of external lands in alternating arrangement with the grooves. The grooves extend longitudinally along the plug body at a helix angle to the central longitudinal axis and closely correspond to internal helical or spiral ribs formed in tubing drawn through the drawing die with the plug body disposed within the lumen of the tubing. Each of the grooves has a cross-section normal to the groove defined by a root surface and a pair of flank surfaces extending angularly outwardly away from one another from the root surface to the land surfaces of a pair of adjacent lands between which the groove is disposed. The flank surfaces extend angularly outwardly from the root surface at different radial angles. The land surfaces have a width and the grooves have a width between their flank surfaces the same as or substantially the same as the width of the land surfaces. Preferably, the helix angle is 40° and the radial angles are 37° and 16°, respectively. The flank surface that has the larger radial angle is disposed closer to a rearward end of the plug body than the flank surface that has the smaller radial angle. Preferably, the plug body has four or more grooves, with the number of lands equaling the number of grooves.

The plug tool may further comprise a connector for connecting the rearward end of the plug body to a forward end of an elongate shaft disposed within the tubing that is drawn through the die orifice. The connector comprises an externally threaded extension extending coaxially from the plug body in a rearward direction for threaded connection in an axial threaded passage in the forward end of the shaft. The connector may be integral and unitary with the plug body or may comprise a separate component.

The plug tool may comprise the plug body, the connector and the shaft, and the forward end of the shaft may comprise a forward end of a back-bar or an adaptor connecting the plug body to the forward end of the back-bar. The back-bar has an external size to fit within the lumen of the incoming tubing, and the adaptor has an external size to fit more closely in the lumen of the incoming tubing than the back-bar. The plug body and the back-bar may be rotatable to rotate the plug body about its central longitudinal axis.

In a cold drawing process utilizing the plug tool, the plug body is rotatably disposed in the die orifice of a drawing die presenting an annular space between the plug body and a constricting surface of the drawing die. The incoming tubing is introduced in the die orifice by being advanced longitudinally along the shaft with the shaft disposed within the tubing. The incoming tubing is inserted in the annular space and is drawn longitudinally through the die orifice over the plug body. The constricting surface constricts the tubing in the die orifice and forces an internal surface or wall of the tubing into the external grooves of the plug body. The plug body is rotated within the die orifice as the tubing is drawn longitudinally therethrough. Accordingly, a plurality of continuous helical or spiral ribs or rifles are formed along the internal surface of the tubing closely corresponding to the external grooves of the plug, except that a clearance is ensured between the tubing material and the root surfaces of the grooves in the plug body.

The present invention is further characterized in a method of producing internally ribbed or rifled tube comprising the steps of drawing a length of tubing longitudinally over a plug body rotatably disposed in a die orifice of a drawing die and having a plurality of external grooves at equally spaced locations about a central longitudinal axis of the plug body extending longitudinally at a helix angle to the central longitudinal axis, wherein each groove has a root surface and a pair of flank surfaces extending from the root surface to adjacent land surfaces of the plug body at different radial angles in opposite directions from one another, and constricting the tubing in the drawing die to force an internal surface or wall of the tubing into the external grooves of the plug to form a plurality of continuous helical ribs extending longitudinally along the internal surface of the tubing and closely corresponding to the grooves. Prior to the step of drawing, the tubing is preferably drawn over a plain plug for proper sizing and is thereafter annealed. Subsequent to the step of annealing and prior to the step of drawing the tubing over the grooved plug body, the tubing is preferably subjected to wet preparation. The tubing may be heat treated subsequent to the step of drawing the tubing over the grooved plug body.

Other features and characteristics of the present invention will become apparent from the following description of the preferred embodiments taken in conjunction with the accompanying drawings, wherein like parts in each of the several figures are identified by the same reference characters.

DESCRIPTION OF THE PREFERRED EMBODIMENTS

Figure 1:
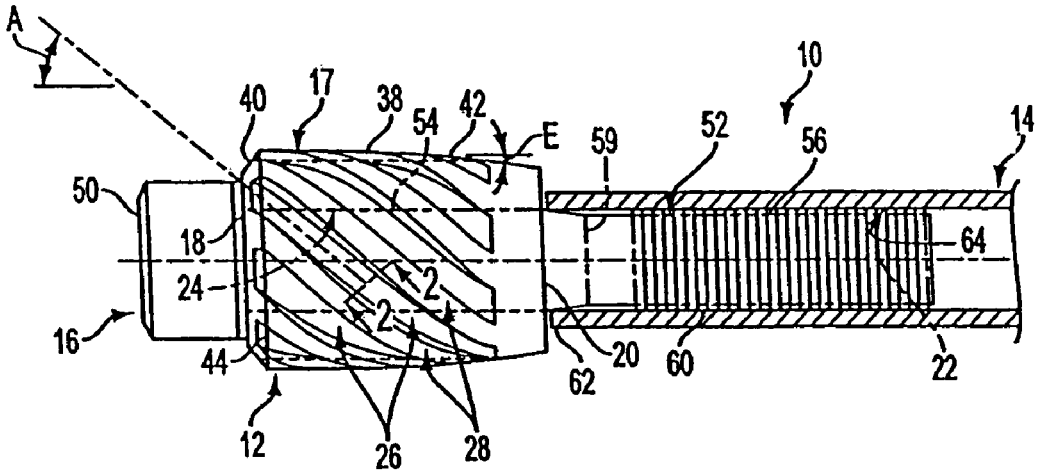
FIG. 1 is a broken side view, partly in section, of a plug tool according to the present invention.
Figure 2:
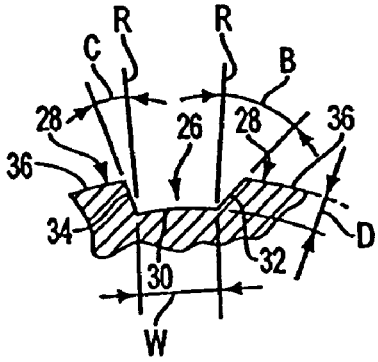
FIG. 2 is an enlarged, fragmentary cross-sectional view of an external groove of a drawing plug of the plug tool taken along line 2—2 of FIG. 1.

A plug tool 10 according to the present invention is depicted in FIG. 1 and comprises a drawing plug 12 assembled to a shaft 14 via a connector 16. The plug 12 has a plug body 17 with a forward end 18, a rearward end 20, a central longitudinal axis 22 and a bore 24 extending therethrough coaxial with the central longitudinal axis 22. The plug 12 is formed with a plurality of external grooves 26 extending longitudinally along the plug at a helix angle A to the central longitudinal axis 22. The grooves 26 are disposed at equally spaced locations about the central longitudinal axis 22 in alternating arrangement with external lands 28, with each groove 26 being disposed between a pair of adjacent lands 28. As seen in FIG. 1, each groove 26 terminates at a forward groove end and at a rearward groove end on the plug body 17. Each land 28 terminates at a forward land end and at a rearward land end on the plug body 17. As shown in cross-section normal to a groove 26 in FIG. 2, each groove 26 comprises a root surface 30 and a pair of flank surfaces 32 and 34 extending angularly outwardly from the root surface 30 to land surfaces 36 of the adjacent lands 28, respectively. The root surface 30 is arcuate and is parallel and concentric with the land surfaces 36 of adjacent lands 28. The flank surfaces 32 and 34 for each groove 26 extend angularly outwardly from the root surface 30 at different radial angles in directions away from one another, such that the grooves 26 are asymmetrical in normal cross section. The flank surface 32 may be considered a rearward flank surface since it is closer to the rearward end 20 and shaft 14 than the flank surface 34, and the flank surface 34 may be considered a forward flank surface located further away from shaft 14 and closer to the forward end 18 than the flank surface 32. As explained below, the rearward flank surfaces 32 face forwardly and toward the forward direction of draw for tubing drawn longitudinally over and relative to the plug body 17. The forward flank surfaces 34 face rearwardly and in opposition to the forward direction of longitudinal draw for the tubing over and relative to the plug body 17. The root surface 30 of each groove 26 has a width W between a radius R and a radius R'. The width W of the grooves 26 at the root surfaces 30 is equal or substantially equal to the width of the land surfaces 36 as near as practically possible. The flank surface 32 defines a first radial flank angle B with the radius R while the flank surface 34 defines a second radial flank angle C, less than the first radial flank angle B, with the radius R'. The rearward flank surface 32 is angled or offset from the radius R in the rearward direction opposed to the forward direction of draw for the tubing. The forward flank surface 34 is angled or offset from the radius R' toward the forward direction of draw for the tubing and is steeper than the rearward flank surface 32. Each groove has a depth D in a radial direction between its root surface 30 and the arc of adjacent land surfaces 36. Preferably, the helix angle A is or is about 40°, angle B is or is about 37° and angle C is or is about 16°. Setting the flank angles to 37° and 16° corresponds to 40° and 69° to the central longitudinal axis of the tubing drawn over the plug 12 as explained further below.

The plug body 17 comprises an intermediate length section 38 disposed between a forward length section 40 and a rearward length section 42. The intermediate length section 38 has an external cylindrical configuration, the forward length section 40 is chamfered, and the rearward length section 42 is tapered. The forward length section 40 is joined to the intermediate length section 38 at a sharp circumferential edge 44 and is chamfered from edge 44 to a planar forward end surface defining forward end 18. The rearward length section 42 is tapered from intermediate length section 38 to a planar rearward end surface defining rearward end 20. Accordingly, the cross-sectional configuration of rearward length section 42 decreases from intermediate length section 38 to rearward end 20, and the rearward length section 42 tapers from the intermediate length section 38 at a taper angle E shown in FIG. 1. The intermediate length section 38 is of uniform constant cross-section between forward length section 40 and rearward length section 42, with the outer diameter of the intermediate length section extending longitudinally in a parallel direction to axis 22. As seen in FIG. 1, the forward groove and land ends are located on the forward length section 40, and the rearward groove and land ends are located on the rearward length section 42.

In a preferred embodiment, the plug 12 has an overall length from forward end 18 to rearward end 20 of or about 49.6 mm; the intermediate length section 38 has a length of or about 25.0 mm; the intermediate length section 38 has an outer diameter of or about 33.3 mm; the forward length section 40 is chamfered from the intermediate length section 38 at a chamfer angle of or about 45°; the taper angle E of rearward length section 42 is or is about 7°; the root surface width W is or is about 4.3 mm; and the depth D of grooves 26 is or is about 1.60 mm. The flank surfaces 32 and 34 are joined to the land surfaces 36 at outer edges which have a radius of curvature of or about 0.5 mm in the preferred embodiment. The flank surfaces 32 and 34 are joined to the root surfaces 30 at inner corners which have a radius of curvature of or about 0.2 mm in the preferred embodiment. The plug 12 has eight external grooves 26 and eight lands 28, but may have four or more external grooves and an equal number of lands. Of course, it should be appreciated that variations to the stated dimensions are possible in accordance with design tolerances. The bore 24 is of uniform diametric cross-section along its length and is of a size to receive a shank of connector 16 therethrough.

The connector 16 may be considered part of the plug tool 10 and comprises a head 50 disposed at the end of a shank 52, with the head 50 having a cross-sectional size larger than the cross-sectional size of bore 24 so that the head is maintained externally of the plug 12 when the shank 52 is received in bore 24 via forward end 18. The shank 52 includes a first length segment 54 extending from head 50 to a second length segment 56 which extends from the first length segment 54 to a terminal end. The first length segment 54 has a cylindrical portion extending from head 50 to a tapered portion which extends from the cylindrical portion to the second length segment 56. The head 50 presents an abutment at the forward end 18 of plug 12 when the shank 52 is inserted through bore 24 with the cylindrical portion disposed in the bore 24. The cylindrical portion has an outer diametric size close to the diametric size of bore 24. The tapered portion, which extends rearwardly from the plug 12, is tapered from the cylindrical portion to the second length segment 56. The second length segment 56 has an outer diametric dimension smaller than the outer diameter of the cylindrical portion, and the tapered portion blends into the outer diameter of the second length segment 56 at a junction 59. The outer diameter of the second length segment 56 forms the root of an external thread 60 disposed on the second length segment 56. The thread 60 begins at a location spaced rearwardly from junction 59 and continues to adjacent the terminal end of shank 52. Preferably, the connector 16 is a high tensile socket head cap screw with a socket cavity in head 50 for receiving a suitable tightening tool. In the case of plug 12, the connector 16 may be an M16 1.5 socket head cap screw having a threaded length of 48.0 mm.

The shaft 14 may be considered part of plug tool 10 and has a forward end 62 with an axial passage 64 therein threaded to threadedly engage the thread 60 on connector 16. The connector 16 is threaded into the passage 64 coaxially and is tightened via a tightening tool engaged in the socket of head 50. When the connector 16 is properly tightened to the shaft 14, the forward end 62 of the shaft forms an abutment at the rearward end 20 of plug 12. The plug 12 is captured between the forward abutment presented by head 50 and the rearward abutment presented by shaft 14 and is constrained against longitudinal movement between the forward and rearward abutments. The forward end 62 of shaft 14 may comprise the forward end of a back-bar or rod or the forward end of an adapter for coupling the plug 12 to the forward end of a back-bar or rod used in a tube drawing process. The back-bar or rod will typically be of considerable length and will normally be supported on a draw bench with the forward end of the back-bar coupled with the plug 12 and a rearward end of the back-bar insertable in the lumen of a length of tubing that is to be moved longitudinally over and along the back-bar in a forward direction during the tube drawing process as explained further below. Typically, the back-bar will be hollow and cylindrical with an external diameter about 3 mm less than the internal diameter of the length of tubing. The rearward end of the back-bar rotates in a thrust bearing 98 shown in FIG. 8. Where the forward end 62 of shaft 14 is the forward end of the back-bar, the back-bar may be coupled directly with the plug 12 via threaded engagement of the connector 16 in the passage 64 at the forward end of the back-bar. Where the forward end 62 of shaft 14 is the forward end of an adapter, the back-bar may be indirectly coupled with plug 12 via the adapter by threaded engagement of the connector 16 in the passage 64 at the forward end of the adapter and by connection of a rearward end of the adapter to the forward end of the back-bar. Once the connector 16 has been tightened to the forward end of shaft 14, it is rotatable with the back-bar as a unit.

Figure 3:
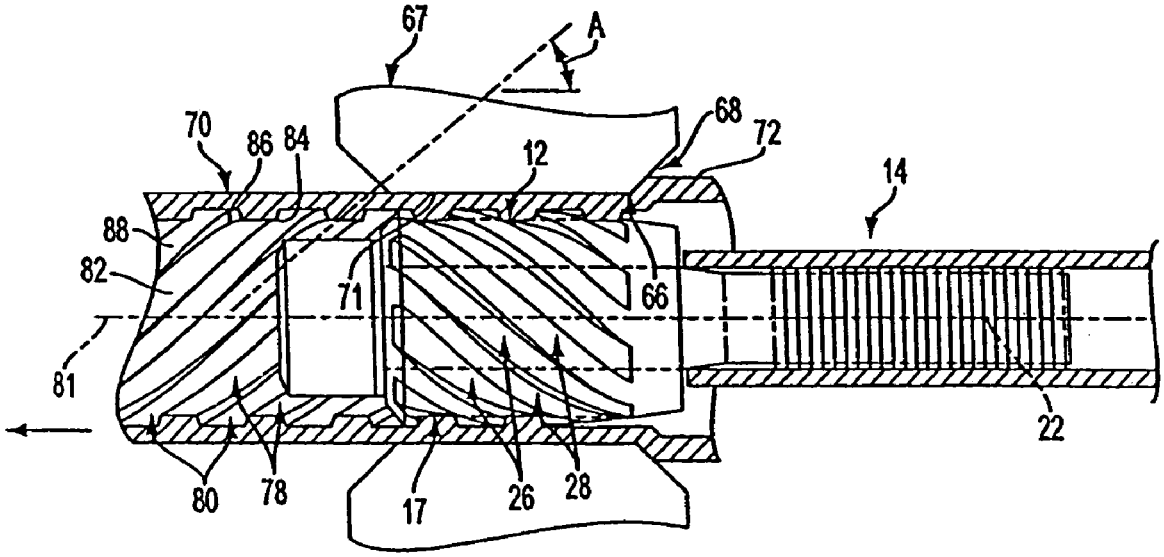
FIG. 3 is a broken side view, partly in section, illustrating cold drawing of a length of tubing over the plug to form internally helically or spirally ribbed or rifled tube according to the present invention.

The plug 12 is used to form internal helical or spiral ribs in tubing in a cold drawing process as depicted in FIG 3. The shaft 14, which comprises the back-bar or the adapter and back-bar, is coupled with plug 12 to extend longitudinally from plug 12 in the rearward direction coaxial with the central longitudinal axis 22 as far as practically possible. The plug 12 is disposed in a die orifice 66 of a drawing die 67 which will typically be rigidly secured to the draw bench. The plug body 17 is rotatable within the die orifice but is constrained against longitudinal movement by the connector and shaft as described above. The die orifice 66 will normally have a cylindrical configuration with an inlet 68 that may be angled or flared to facilitate the insertion of an end of a length of steel tubing 70 into the die orifice 66 for being drawn longitudinally over and relative to the plug 12 as the tubing is moved longitudinally in the forward direction over and along the shaft 14 as shown by an arrow in FIG. 3. The plug body 17 is centrally located within the die orifice 66 such that an annular gap or space is presented between the plug body 17 and a constricting surface 71 of die 67 to receive the circumferential wall 72 of an incoming length of the tubing 70 which is drawn over the plug body to have internal ribs or rifles formed therein. Tubing 70 is selected from raw hollow tubing in which the circumferential wall 72 defines an external circumferential surface, an internal circumferential surface and a lumen circumscribed by the internal circumferential surface. The circumferential wall 72 has an initial wall thickness between the external and internal circumferential surfaces, and the initial wall thickness is sufficiently greater than the radial dimension of the annular gap between plug body 17 and the constricting surface 71 of die 67 so that the circumferential wall 72 of the tubing 70 is constricted by the constricting surface and forced into the grooves 26 of plug body 17 as the tubing 70 is drawn through the die orifice 66 in the forward direction. The tubing 70 is constrained from rotating as it is drawn through the die orifice.

As the tubing 70 is drawn through the die orifice 66 over plug 12, constriction or compression of the circumferential wall 72 by the die 67 causes the internal surface or wall of tubing 70 to be forced into the grooves 26 of plug 12. The tubing 70 is drawn longitudinally through the die orifice 66 and along the plug 12 in the direction of the arrow, and typically the tubing is drawn by a drawing mechanism. The drawing mechanism may comprise a carriage disposed on the draw bench forwardly of the die 67 and having a gripping assembly for gripping the tubing 70, with the carriage being movable along a track in the forward direction to pull the tubing in the forward direction. The carriage grips the point of the tubing 70 and constrains it from rotating. As the forward component of force moves the tubing 70 through the die orifice 66, the helical grooves 26 in the plug 12 interact with the wall 72 of the tubing 70 to cause the plug 12 to rotate about the central longitudinal axis 22. The direction of this rotation serves to tighten the connector 16 on the shaft 14 and ensures that the rotation of plug 12 is imparted to the back-bar which, being mounted on the thrust bearing, can rotate at the same rotational speed as the plug. The drawn length of tubing 70 exiting the die orifice 66 has internal helical or spiral ribs or rifles 78 formed in its internal surface closely corresponding to the external grooves 26 of plug 12. The ribs 78 are spaced from one another by internal grooves 80 formed in the internal surface in close correspondence with the external lands 28 of the plug 12. The tubing 70 will have a plurality of internal ribs 78 equally spaced about a central longitudinal axis 81 of the tubing and extending longitudinally along the tubing at the helix angle A to the central longitudinal axis 81 of the tubing.

Figure 4:
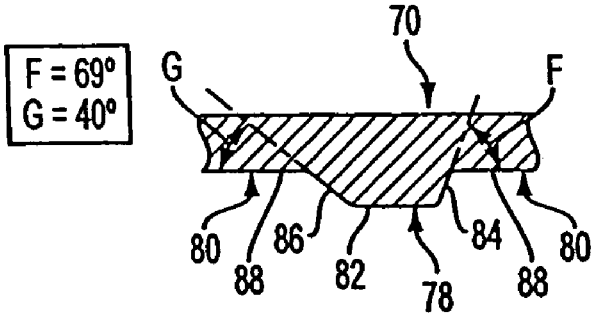
FIG. 4 is an enlarged fragmentary cross-sectional view of the tubing taken in longitudinal or axial section and depicting an internal rib formed in the tubing.

As shown in longitudinal or axial cross-section in FIGS. 3 and 4, each rib 78 has a land surface 82 and a pair of flank surfaces 84 and 86 extending angularly outwardly from the land surface in directions away from one another to the root surfaces 88 of a pair of adjacent grooves 80 between which the rib is disposed. The flank surfaces 84 and 86 for each rib 78 extend outwardly from its land surface 82 at different angles such that each rib is asymmetrical in cross-section. The land surface 82 for each rib 78 has a width between its flank surfaces 84 and 86 equal to the width of grooves 80 as near as practically possible. The land surfaces 82 of the ribs 78 are parallel to the root surfaces 88 of the adjacent grooves 80. Each rib 78 has a depth between its land surface 82 and the adjacent root surfaces 88. The internally ribbed or rifled tubing 70 provides an optimized rib configuration in which the rib flank surfaces 84 and 86, as near as practically possible, present a larger lead angle F of or about 69° and a narrower trail angle G of or about 40°, respectively, to the central longitudinal axis 81 when viewed in axial or longitudinal section as shown in FIG. 4. The ribs 78 and the grooves 80 are of the same or substantially the same width as near as practically possible. The thickness of the wall 72 of the incoming tubing is selected to obtain a desired height for ribs 78. The depth D of grooves 26 is greater than the desired rib height so that the land surfaces 82 of the ribs 78 do not contact the root surfaces 30 of grooves 26. The drawn tubing 70 essentially retains its cylindrical external configuration due to the cylindrical configuration of die 67, but is of reduced wall thickness. The incoming tubing 70 is advanced along shaft 14 as it is continued to be drawn into and through the die orifice 66 with each rib 78 and groove 80 being continuous from beginning to end due to continuous rotation of plug 12 within the die orifice 66. The incoming length of tubing and/or the length of drawn tubing 70 exiting from the drawing die 67 may be supported by support structures located along the draw bench.

The geometry of the ribs 78 is determined by the grooves 26, the position of the plug 12 relative to the die 67, the angle of die inlet 68, the diameter of the die orifice 66, and the thickness and hardness of tubing 70. The optimized rib configuration extends high heat transfer rates further by keeping a high density/low enthalpy film in contact with the tube longer at lower mass fluxes and at high bulk fluid enthalpies. When used in a once-through boiler with a vertical tube arrangement the optimized rib configuration allows low mass velocity which in turn offers reduced pressure loss, reduced boiler water feed pump power requirements, positive flow characteristics to suit variable heat fluxes, lower heat rates through sliding pressure operation resulting in power savings, increased boiler continuous output, reduced furnace temperatures, smaller tube to tube temperature differences, simpler and less expensive construction due to self-supporting furnace walls, the elimination of valves between furnace and superheater, the elimination of flow balancing valves, and shorter installation times.

The optimized rib configuration enhances the tube water side heat transfer coefficient to a high extent. The optimized rib configuration keeps a high density/low enthalpy film in contact with the inner surface of the tube longer and therefore prolongs a high heat transfer rate at low mass flux and high bulk fluid enthalpy. Testing indicates a plain drawn tube departs nucleate boiling at a little over 0.6 steam fraction while tubing having the optimized rib configuration resulting from the plug tool of the present invention exhibits departure at 0.93 steam fraction by weight with a low mass flux flow. With excellent heat absorption of the water side, tube temperature is reduced and heat transfer efficiency is increased. Tests confirm that pressure losses are reduced dramatically, which in turn reduces boiler feed pump power requirements. The internally helically or spirally ribbed or rifled tubing resulting from the plug tool of the present invention is particularly applicable to a once-through boiler furnace with a vertical tube furnace arrangement.

For all furnaces, an increase in heat input to a tube reduces the static component of pressure loss. In high mass flux, the reduction in static pressure is offset by a large increase in dynamic pressure loss resulting in a net increase in pressure drop with heat input. With low mass flux, the dynamic pressure loss is small resulting in a net reduction in pressure loss with an increase in heat input. Since the tubes in high and low mass flux furnaces are connected to common headers, the flow in the tube with above average heat will change until it falls off to average. In the high mass flux furnace, the tube flow must be reduced, a negative response, while in the low mass flux furnace the flow must be increased, a positive response. The optimized rib configured tube obtained with the plug tool according to the present invention offers reduced tube temperature in the furnace, lower tube to tube temperature differences, the elimination of valves between the furnace and superheater, the elimination of flow balancing valves, simpler construction because the walls are self-supporting, and shorter installation times.

Figure 5:
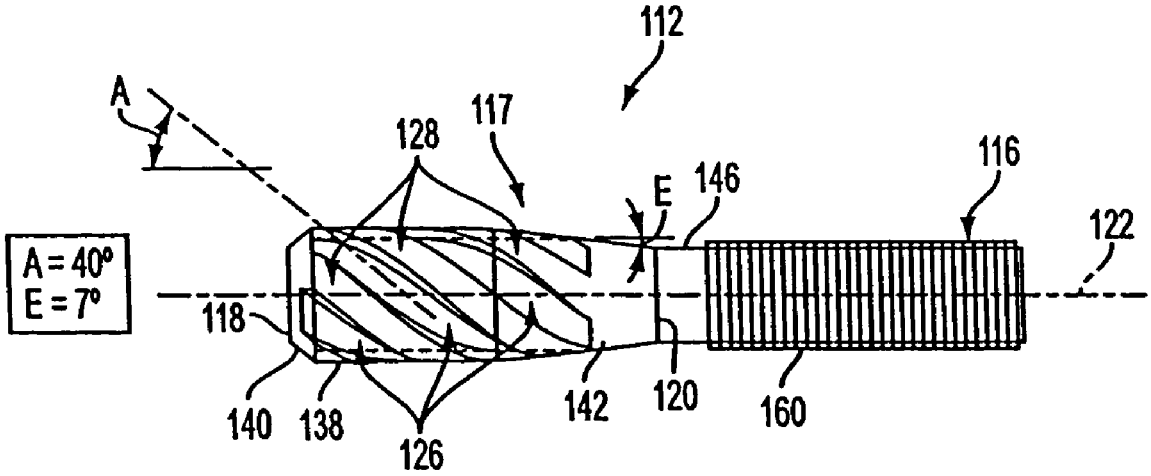
FIG. 5 is a side view of an alternative drawing plug according to the present invention.

FIG. 5 illustrates an alternative plug 112 according to the present invention in which the connector 116 is integral and unitary with the plug body 117 and does not comprise a separate component, as is necessary for drawing tubing 70 of smaller diametric bore sizes. The plug body 117 is similar to plug body 17 and comprises forward end 118, rearward end 120 and central longitudinal axis 122. The plug 112 has external grooves 126 and external lands 128 on plug body 117 as described for plug 12. Similar to plug body 17, the plug body 117 has intermediate length section 138 disposed between forward length section 140 and rearward length section 142. The intermediate length section 138 and the forward length section 140 are similar to intermediate length section 38 and forward length section 40. The rearward length section 142 is similar to the rearward length section 42 except that the rearward length section 142 is joined to an extension 146 at the rearward end 120 of plug body 117. The rearward length section 142 tapers from the intermediate length section 138 to the extension 146 at the taper angle E.

The connector 116 comprises the extension 146, which extends longitudinally rearwardly from the plug body 117 coaxial therewith to a terminal end of the extension. The rearward length section 142 blends into the outer diameter of the extension 146 at a junction formed by rearward end 120. An external thread 160 is disposed on the extension 146 beginning at a location spaced rearwardly from rearward end 120 and continuing to adjacent the terminal end of the extension. The thread 160 is threadedly engageable with a threaded passage, such as passage 64, in a forward end of a shaft, and the forward of the shaft may comprise the forward end of a back-bar or the forward end of an adapter as explained above for shaft 14. Most typically, the connector 116 will be connected to an adapter as described further below.

The plug 112 is representative of a plug that has four grooves 126 and four lands 128. The helix angle A, the flank angles and the width for grooves 126 may be the same as those for grooves 26. In one embodiment for plug 112, the plug 112 has an overall length of or about 99.9 mm; the intermediate length section 138 has a length of or about 25.0 mm and an outer diameter of or about 17.9 mm; the forward length section 140 is chamfered from the intermediate length section 138 at a chamfer angle of or about 45°; the taper angle E is or is about 7°; and the depth of grooves 126 is or is about 1.3 mm. The radii of curvature for the outer edges and inner corners may be the same as those for plug 12. The width of the grooves 126 is equal or substantially equal to the width of the land surfaces 128 as near as practically possible. The extension 146 may comprise an integral M14 1.25 threaded extension with a threaded length of 42.0 mm.

In another representative embodiment of plug 112, the plug 112 has four grooves 126 and four lands 128; the helix angle, flank angles and width for grooves 126 are the same as those for groove 26; the plug 112 has an overall length of or about 104.0 mm; the intermediate length section 138 has a length of or about 25.0 mm and an outer diameter of or about 18.9 mm; the forward length section 140 is chamfered from the intermediate length section 138 at a chamfer angle of or about 45°; the taper angle E is or is about 7°; the depth of grooves 126 is or is about 1.3 mm; the radii of curvature for the outer edges and inner corners are the same as those for plug 12; and the extension 146 comprises an M14 1.25 threaded extension with a threaded length of about 42.0 mm.

In a further embodiment of plug 112, the plug 112 has six grooves 126 and six lands 128; the helix angle and flank angles for grooves 126 are the same as those for grooves 26; the width of grooves 126 is or is about 3.9 mm; the plug 112 has an overall length of or about 118.9 mm; the intermediate length section 138 has a length of or about 25.0 mm and an outer diameter of or about 22.5 mm; the forward length section 140 is chamfered from the intermediate length section 138 at a chamfer angle of or about 45°; the taper angle E is or is about 7°, the depth of grooves 126 is or is about 1.4 mm; the radii of curvature for the outer edges and inner corners are the same as those for plug 12; and the extension 146 comprises an M16 1.5 threaded extension with a threaded length of about 48.0 mm.

In yet another embodiment for plug 112, the plug 112 has six grooves 126 and six lands 128; the helix angle, flank angles and width for grooves 126 are the same as those for grooves 26; the plug 112 has an overall length of or about 141.8 mm; the intermediate length section 138 has a length of or about 25.0 mm and an outer diameter of or about 28.4 mm; the forward length section 140 is chamfered from the intermediate length section 138 at a chamfer angle of or about 45°; the taper angle E is or is about 7°; the depth of grooves 126 is or is about 1.6 mm; the radii of curvature for the outer edges and inner corners are the same as those for plug 12; and the extension 146 comprises an M18 1.5 threaded extension with a threaded length of 54.0 mm.

The plugs 12, 112 are preferably made of tool steel (ASP 23) machined all over leaving a 0.25 grinding allowance on the outer diameter and tapers and a 0.15 grinding allowance on the internal bore. The plugs are preferably hardened and triple tempered to 63 RC, with the outer diameter, tapers and bore being finish ground. A deposition of titanium nitride (TicN) may be deposited 13 μm thick onto the grooves, outer diameter and tapered surfaces, and the plugs may be polished to a mirror finish. The plugs may be coated with mono-molecular diamond or titanium nickel carbide.

Figure 6:
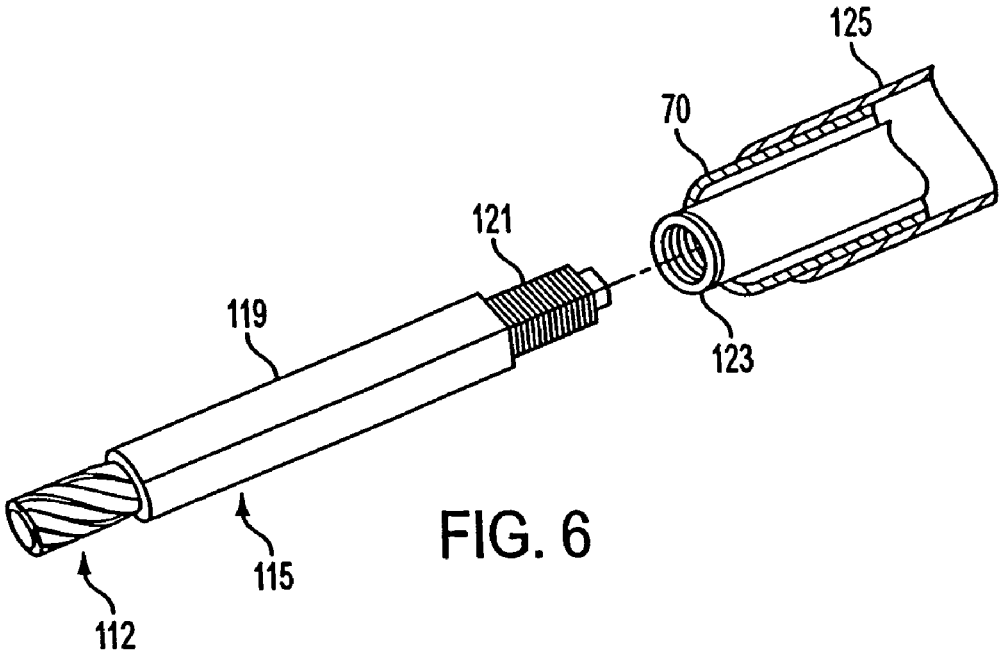
FIG. 6 is a perspective view of an alternative plug tool according to the present invention including an adapter.
Figure 7:
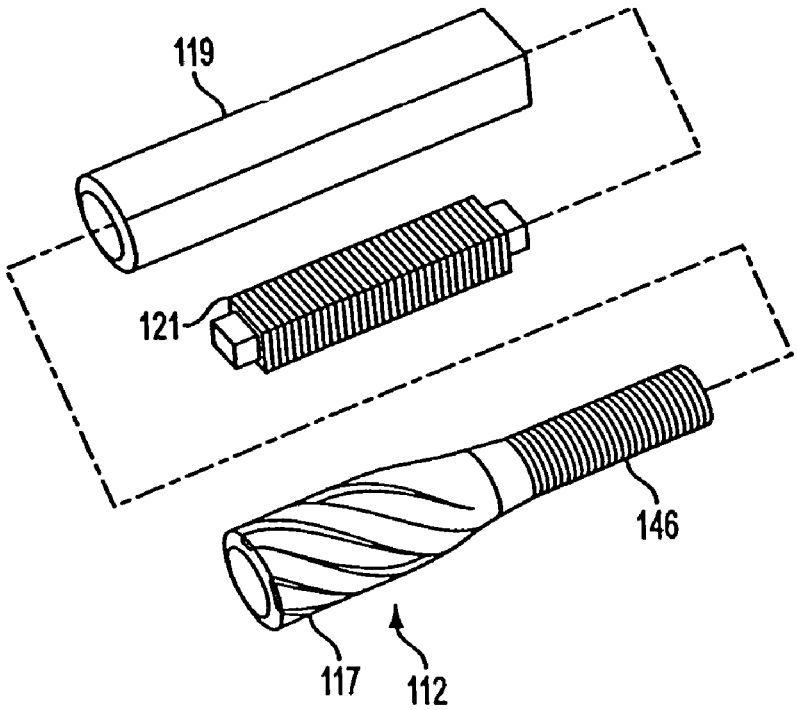
FIG. 7 is an exploded perspective view of a drawing plug and the adapter for the plug tool of FIG. 6.

FIG. 6 depicts an alternative plug tool 110 including plug 112 and shaft 114 wherein the forward end of shaft 114 comprises an adapter 115. As shown in FIGS. 6 and 7, adapter 115 includes a sleeve 119 and a coupling 121. The sleeve 119 is of cylindrical configuration having forward and rearward ends and an axial passage 164 therethrough for threadedly receiving the extension 146 of plug 112 inserted in the passage 164 via the forward end 162 of the sleeve 119. Preferably, the sleeve 119 has a chamfered or beveled surface at its forward end 162 from its outer diameter to the opening into passage 164. The coupling 121 has an externally threaded coupling portion for securement in the passage 164 of sleeve 119. The coupling 121 may have first and second ends of straight-sided cross-sectional configuration, e.g. square, respectively extending from opposite ends of the externally threaded coupling portion. When the adapter 115 is assembled to the plug 112 as depicted in FIG. 6, the sleeve 119 extends over the rearward end 120 and part of the rearward length section 142 of the plug body 117, with the forward surface of the sleeve 119 adjacent or close to the rearward ends of the grooves 126. The rearward end of the sleeve 119 extends or protrudes rearwardly beyond the terminal end of the extension 146, and the second end of the coupling 121 extends or protrudes rearwardly beyond the rearward end of sleeve 119 for connection to the forward end of the back-bar 123. The second end of coupling 121 may be connected to the back-bar 123 in any suitable way and may be threaded into an axial bore in the forward end of the back-bar and/or by welding to the back-bar. In addition, various connections can be used to connect the first end of the coupling 121 to the sleeve 119 and/or to the extension 146. The outer diameter of the sleeve 119 is selected for a closer fit in the lumen of the tubing 70 than the fit between the lumen of the tubing and the outer diameter of the back-bar 123. The adapter 115 establishes a more robust connection of the plug to the back-bar and provides greater support to reduce rotary bending loads on the plug. When the plug tool 110 is used in a drawing process, the back-bar 123 carries axial load through the thrust bearing, and the back-bar 123 rotates correspondingly with the plug 112 due to a rigid connection between the plug 112 and the back-bar 123 provided via the adapter 115. Conical faces on the inside of the adaptor 115 and on the outside of the plug assist transmission of torque without over-tightening the coupling 121.

Where the diameter of the lumen of the tubing 70 is relatively small, the outer diameter of the back-bar 123 must also be relatively small to fit within the lumen of the tubing. Since the back-bar is subjected to compressive and tensile loads, a small diameter back-bar may be adapted to better sustain such loads by being guided within a guide tube 125 as shown in FIG. 6. The guide tube 125 will typically be supported on the draw bench and has an inner diameter large enough to accommodate the outer diameter of the tubing 70 that is drawn over the back-bar 123 within the guide tube.

Figure 8:
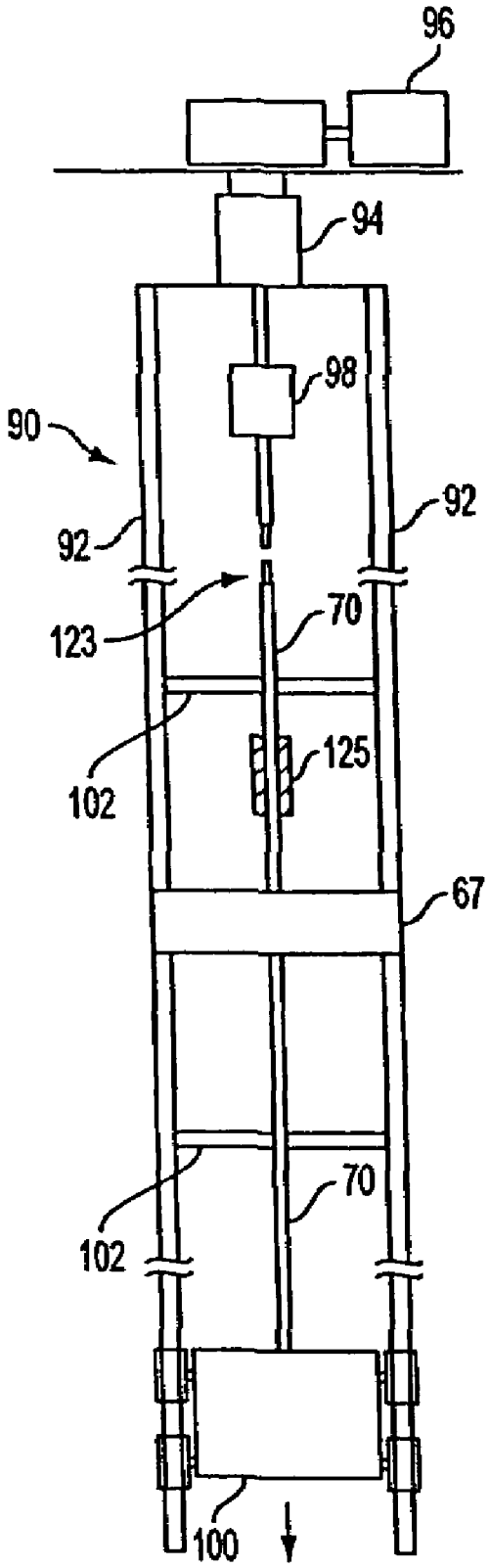
FIG. 8 is a broken plan view of a draw bench used to form internally helically or spirally ribbed or rifled tube in a cold drawing process using the plug tools of the present invention.

FIG. 8 illustrates a representative draw bench 90 for use in a cold drawing process wherein a plug tool according to the present invention is used to form internal helical or spiral ribs or rifles in tubing 70. The draw bench 90 may include longitudinally extending parallel rails 92 of sufficient length to accommodate the incoming and drawn lengths of tubing 70 to and from the drawing die 67 mounted along the draw bench. The back-bar 123 is mounted between the rails 92, and the rearward end of the back-bar is coupled with a back-bar actuator 94 powered by a motor 96. The back-bar actuator 94 may be operable remotely from a control station. A rotary thrust bearing 98 is provided along the length of the back-bar 123 for carrying axial loads as the back-bar is allowed to rotate. The plug 12, 112 coupled to the forward end of the back-bar 123 is positioned in the die orifice of the drawing die 67 via the actuator 94 moving the back-bar 123 axially. As explained above, the plug may be coupled to the forward end of the back-bar 123 directly or indirectly via an adapter such as adapter 115. As explained further below, the plug coupled to the forward end of the back-bar 123 may be a plain plug, similar to plugs 12, 112 but without external grooves and lands, over which the tubing 70 is drawn prior to the tubing 70 being drawn over the grooved plug 12, 112 in the method according to the present invention explained further below.

The axial position of the plug 12, 112 in the die orifice of the drawing die 67 must not be too far rearwardly or else the plug will not be engaged with the tubing 70 drawn through the die orifice with the back-bar 123 disposed in the lumen of the tubing. The axial position of the plug 12, 112 in the die orifice must not be too far forwardly or else the tubing material will land on the rearward portion of the plug generating unacceptably high loads on the plug and back-bar which may cause violent oscillations and/or breakage of the plug and/or back-bar. In setting the position of the plug 12, 112 prior to a draw, the actuator 94 is operated to move the back-bar and, therefore, the plug, rearwardly to take up necessary clearances. When the plug 12, 112 is properly positioned in the die orifice, the loads on the back-bar 123 will be modest and the axial pitch or helix angle of the ribs formed in the tubing will be within tolerance. Axial pitch of the ribs can be checked visually from the outside of the tubing 70. The ribs are visible from the outside of the tubing without there being a measurable local surface effect. The rails 92 provide a track for a movable carriage 100 which has a gripping assembly, such as opposed clamping jaws, for gripping the drawn length of tubing 70 and constraining it against rotation. The carriage 100 is movable along the rails 92 to pull the tubing 70 through the drawing die 67. Suitable supports 102 may be provided at spaced locations along the draw bench 90 for supporting the incoming length of tubing 70 and/or the drawn length of tubing 70. FIG. 8 also shows a sectional length segment of a guide tube 125 within which the incoming length of tubing 70 may be disposed during a draw.

The grooved plugs 12, 112 according to the present invention can be attached to a shaft comprising a back-bar or an adapter and a back-bar. The grooved plugs may be directly coupled with a forward end of the back-bar without an adapter between the grooved plug and the back-bar, or the grooved plugs may be coupled indirectly with a forward end of the back-bar via an adapter between the plug and the back-bar as explained above. The grooved plugs can be coupled to a forward end of the shaft in various ways using connectors formed integrally and unitarily with the plug or connectors formed as separate components. The shaft is of sufficient length to accommodate the incoming length of the tubing. The plug rotates within the die orifice as the tubing is drawn therethrough. The shaft rotates as one with the plug and the shaft is supported for rotation by a rotary thrust bearing.

A relatively small diameter shaft can be disposed within a guide tube 125 having an internal diameter capable of accommodating the outer diameter of the tubing within which the shaft is disposed. The guide tube 125 prevents the back-bar from buckling beyond the limits of the bore of the guide tube when the plug is being pushed by the back-bar toward its correct position before the draw commences and thereby maintains the force on the plug needed to achieve the correct position. Also, the guide tube 125 prevents the back-bar from whirling beyond the limits of the bore of the guide tube when the draw is in progress and the plug and back-bar are rotating. Whirling would create a fluctuating load and bending moments on the connector 116, the adaptor 115, the sleeve 119 and the coupling 121 which in turn would cause breakage of one or more of these components.

The tubing can be drawn through the die orifice by a pulling force applied by a carriage 100 moveable on a track of the draw bench. The carriage may comprise any suitable gripping mechanism for releasably gripping the tubing and constraining it against rotation. The draw bench may be of sufficient length to accommodate the incoming and the drawn lengths of the tubing. A motorized back rod actuator 94 is used to effect axial movement of the back-bar for proper positioning of the plug in the die orifice. The back-bar actuators may be operated remotely from a control station.

Figure 9:
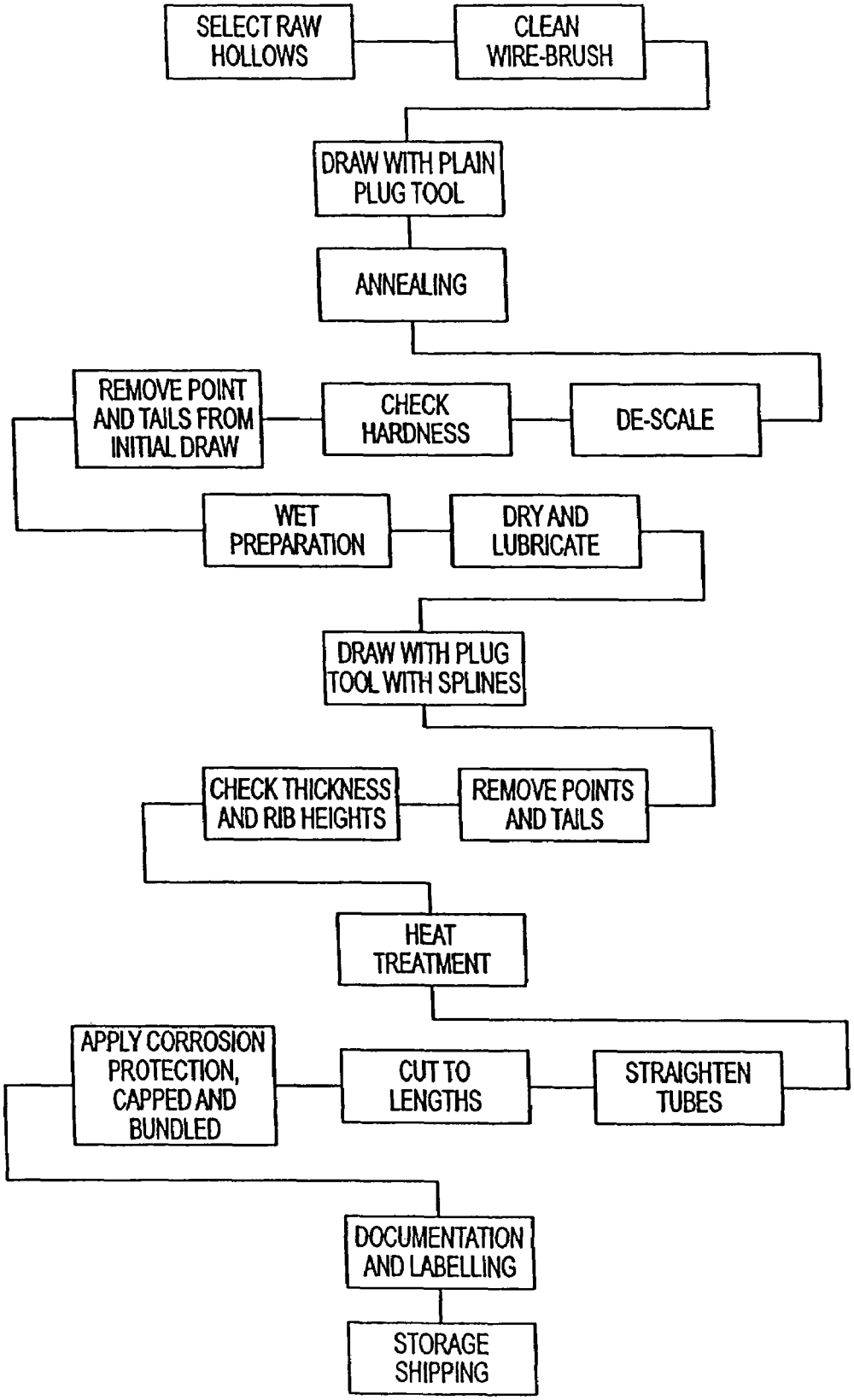
FIG. 9 is a flow chart representing a method of producing internally helically or spirally ribbed or rifled tube according to the present invention.

A fast and economical method of producing internally helically or spirally ribbed or rifled tube consistently in commercial quantities is represented in FIG. 9. According to the method, lengths of diametrically oversized raw hollows are selected according to desired finished diameter, wall thickness and other factors as represented by the selection of tubing 70 prior to drawing as described above. Factors to be considered when selecting the length of raw hollow tubing to be drawn include the increase in length of the tubing resulting from a reduction in cross-sectional area of the tubing due to drawing as constant volume is maintained, the capacity of the draw bench to accommodate both the incoming and drawn lengths of the tubing and to exert the required drawing force, the combined rib and tube wall cross-sectional area, the tubing material lost in forming the points for each draw needed, and the loss of tubing material due to poorly formed wall at the tail end of the tubing. The raw tubing is initially prepared by wire-brushing, wet cleaning or preparation, lubricating and drying. Typically, a wire brush carried at the end of an elongate shaft is inserted in the lumen of the raw tubing to remove scale from the inner surface or wall of the tubing. Wet cleaning removes further scale by chemical means. Lubricating is with soap.

The prepared raw tubing is drawn, such as along a draw bench 90, through a die orifice of a drawing die, similar to drawing die 67, and over a plain plug, similar to plugs 12, 112 but without external grooves and lands, disposed in the die orifice of the drawing die. The plain plug is coupled with a back-bar, such as back-bar 123, and connected to a motorized back-rod actuator used to position the plug in the die orifice as described above. The tubing is moved forwardly along the back-bar for passage through the drawing die over the plain plug, with the back-bar disposed in the lumen of the tubing. Pairs of plain plugs may be connected to the forward ends of a pair of back-rods, respectively, which may be supported in side by side relation on a draw bench and used alternately to speed up production. Drawing is accomplished by moving the prepared raw tubing 70 forwardly through the drawing die, and the tubing may be pulled through the drawing die by a carriage, such as carriage 100. Drawing the tubing 70 over the plain plug obtains a desired diameter for the tubing and precisely sizes the tubing for the ribbed draw. The wall thickness of the plain drawn tubing 70 is checked using a snap gauge to measure tube wall thickness at a plurality of locations around the periphery of one end of the tubing. If necessary, the raw tubing may be annealed prior to drawing the tubing over the plain plug so that the tubing is soft enough for the plain draw.

Subsequent to the plain draw, the tubing is annealed and thereafter the annealed tubing is descaled to remove loose scales and debris. Prior to descaling, the annealed tubing may be cooled. After descaling, the hardness of the tubing is checked by measuring the hardness of a sample of the tubing. Hardness is checked on samples from a batch of tubes after annealing and wet preparation, with the number of samples for which hardness is checked depending on the behavior of the draw bench. Points and tails that resulted from the plain draw are removed to allow passage and complete drainage of wet preparation reagents in the lumen and full air release. After the points and tails have been removed, the tubing is subjected to wet preparation, which may involve the same steps as wet cleaning the tubing prior to the plain draw. Wet preparation or cleaning involves removing oxides from the tubing, passivating the surface of the tubing, soaping the tubing and drying the tubing. Removing oxides involves soaking or dipping the tubing in a solution, such as sulphuric acid, to remove oxides, draining the solution from the tubing and rinsing the tubing in water, followed by soaping the tubing, rinsing the tubing in water, and drying the tubing. The steps of soaking/dipping, draining and rinsing may be repeated as necessary until the effluent from acid treatment runs clear from both ends of the tubing. Passivating involves soaking or dipping the tubing in a passivating solution, such as a phosphate solution, and the step of soaking/dipping in a passivating solution may be repeated as necessary. Soaping involves soaking or dipping the tubing in a soap solution and draining the soap solution from the tubing. The steps of soaking/dipping in a soap solution and draining may be repeated as necessary. Drying involves drying the drained tubing with warm air.

The dried tubing is drawn through the die orifice 66 of drawing die 67 over the grooved or splined plug 12, 112 disposed in the die orifice as described above. The ability to perform the ribbing draw, i.e. the draw over the grooved (splined) plug 12, 112, is dependent on the condition of the prepared tubing, suitable tubing hardness, freedom from oxide and scale inclusions on the bore surface of the tubing, dimensional accuracy over the length of the tubing, adequately formed point and consistently formed layers of lubricant on the outer and inner diameter surfaces of the tubing, the design and condition of the grooved plug including the deposition or coating thereon, the strength of the connection between the grooved plug and the back-bar, alignment of the back-bar, plug dimensions including groove helix angle, edge radii, leading and trailing flank angles, and groove depth and width, and draw speed.

After the tubing has been drawn through the die orifice over the grooved plug 12, 112 to form ribs 78 and grooves 80, points and tails are removed from the tubing. Then the rib pitch is checked over fifty rib pitches using a steel tape. This can be performed from the outside of the tubing as the ribs are visible from the outside of the tubing. Thereafter, the wall thickness and the height of ribs 78 for a sample taken from one end of the tubing are checked, typically using a pin micrometer. After checking the tubing for proper wall thickness and rib height, the tubing is subjected to heat treatment needed to obtain desired mechanical properties. The heat treated tubing is then straightened as needed, externally marked and cut to desired lengths to obtain one or more tubes having internal helical or spiral ribs or rifles. Subsequent to straightening and prior to cutting, the tubing may be examined for flaws and may be marked with an identifying code number. The cut tubes are blown to remove swarf, and corrosion protection substances are applied to the tubes. Vapor release pellets may be used for corrosion protection. The tubes are capped at their ends and bundled into groups containing a desired number of individual tubes. The tubes are documented and labeled, and the documented and labeled tubes may be stored prior to shipping to a designated site. Multiple slings may be used to safely lift bundles of the finished tubes. The finished tubes essentially have a major bore that determines the wall thickness and a minor bore that determines the rib height. The desired rib height is obtained by selecting a hollow of appropriate wall thickness, as determined from trials using a range of hollows of different wall thicknesses.

The method according to the present invention provides faster production times, reduces the forces applied to the plug tool during manufacture, eliminates the frequency of tool breakages and tool changes, and results in a finished internally helically or spirally ribbed or rifled tube with the desired mechanical properties and heat transfer and pressure loss characteristics. The method features a triple tempered and coated splined or grooved plug tool that freely rotates to produce the internal ribs within a drawing die. A manufacturing or draw bench with a control station positions the actuators to take up clearances, centers the plug in the die orifice and controls the drawing operation. Pre-draw and post-draw preparations produce consistent quality in finished internally ribbed or rifled tubes.

Inasmuch as the present invention is subject to many variations, modifications and changes in detail, it is intended that all subject matter discussed above or shown in the accompanying drawings be interpreted as illustrative only and not be taken in a limiting sense.

What is claimed is:

1. A plug tool for forming internally helically ribbed tube, comprising a plug including a plug body for being rotatably disposed in a die orifice of a drawing die and having a central longitudinal axis, a plurality of external grooves equally spaced about said central longitudinal axis, and a plurality of external lands in alternating arrangement with said grooves, each of said plurality of grooves terminating at a forward groove end and at a rearward groove end on said plug body, each of said plurality of lands terminating at a forward land end and at a rearward land end on said plug body, said grooves extending longitudinally along said plug body at a helix angle to said central longitudinal axis and closely corresponding to internal helical ribs formed in tubing drawn longitudinally over and relative to said plug body in a forward direction through the die orifice as said plug body rotates within the die orifice and the tubing, each of said plurality of grooves having a cross-section normal to said groove defined by a root surface and a pair of flank surfaces extending angularly outwardly away from one another from said root surface to land surfaces of adjacent ones of said lands, each of said pair of flank surfaces including a forward flank surface facing in opposition to the forward direction of draw for the tubing over said plug body and extending angularly outwardly from said root surface at an angle, and a rearward flank surface facing toward the forward direction of draw for the tubing over said plug body, said rearward flank surface extending angularly outwardly from said root surface at an angle less steep than said angle of said forward flank surface.

2. The plug tool recited in claim 1 wherein said plug body comprises an intermediate length section disposed between a forward length section and a rearward length section, said intermediate length section defining an external cylindrical configuration, said forward length section being externally chamfered from said intermediate length section to a forward end of said plug body, said rearward length section being externally tapered from said intermediate length section to a rearward end of said plug body.

3. The plug tool recited in claim 2 wherein said forward groove ends and said forward land ends are located on said forward length section and said rearward groove ends and said rearward land ends are located on said rearward length section.

4. The plug tool recited in claim 1 wherein said plug body comprises four or more of said external grooves and a number of said external lands equal to the number of said external grooves.

5. The plug tool recited in claim 1 wherein said plug body is integral and unitary with a connector comprising an externally threaded extension extending coaxially from said plug body in a rearward direction for threaded connection in a passage in a forward end of a shaft received in the tubing drawn through the die orifice.

6. The plug tool recited in claim 1 wherein said plug body includes a bore extending longitudinally therethrough coaxial with said central longitudinal axis.

7. The plug tool recited in claim 6 and further comprising a connector having a head disposed at an end of a shank, said shank having a cylindrical length portion extending rearwardly from said head and a threaded length portion extending rearwardly from said cylindrical length portion, said shank being insertable in said bore with said head disposed externally of said plug adjacent a forward end of said plug body, said cylindrical length portion disposed in said bore, and with said threaded length portion extending rearwardly from said plug body for threaded connection in a passage in a forward end of a shaft received in the tubing drawn through the drawing die.

8. The plug tool recited in claim 1 wherein said plug body is caused to rotate within the die orifice and the tubing in response to the tubing being drawn longitudinally over said plug body in the forward direction through the die orifice.

9. The plug tool recited in claim 1 wherein said angle of said rearward flank surfaces is a radial angle of about 37° and said angle of said forward flank surfaces is a radial angle of about 16°.

10. A plug tool for forming internally helically ribbed tube, comprising a plug including a plug body for being rotatably disposed in a die orifice of a drawing die and having a central longitudinal axis, a plurality of external grooves equally spaced about said central longitudinal axis, and a plurality of external lands in alternating arrangement with said grooves, said grooves extending longitudinally along said plug body at a helix angle to said central longitudinal axis and closely corresponding to internal helical ribs formed in tubing drawn in a forward direction through the drawing die with said plug body disposed within the tubing, each of said grooves having a cross-section normal to said groove defined by a root surface and a pair of flank surfaces extending angularly outwardly away from one another from said root surface to land surfaces of adjacent ones of said lands, said flank surfaces extending angularly outwardly from said root surface at different angles, wherein said helix angle is 40°, a rearward one of said flank surfaces of each of said grooves defines a radial angle of 37°, and a forward one of said flank surfaces of each of said grooves defines a radial angle of 16°.

11. The plug tool recited in claim 10 wherein said grooves have a width and said land surfaces have a width at least substantially the same as said width of said grooves.

12. A plug tool for forming internally helically ribbed tube, comprising a plug including a plug body for being rotatably disposed in a die orifice of a drawing die and having a central longitudinal axis, a plurality of external grooves equally spaced about said central longitudinal axis, and a plurality of external lands in alternating arrangement with said grooves, said grooves extending longitudinally alone said plug body at a helix angle to said central longitudinal axis and closely corresponding to internal helical ribs formed in tubing drawn in a forward direction through the drawing die with said plug body disposed within the tubing, each of said grooves having a cross-section normal to said groove defined by a root surface and a pair of flank surfaces extending angularly outwardly away from one another from said root surface to land surfaces of adjacent ones of said lands, said flank surfaces extending angularly outwardly from said root surface at different angles, said plug body comprising an intermediate length section disposed between a forward length section and a rearward length section, said intermediate length section defining an external cylindrical configuration, said forward length section being externally chamfered from said intermediate length section to a forward end of said plug body, said rearward length section being externally tapered from said intermediate length section to a rearward end of said plug body, wherein said rearward length section is externally tapered at an angle of about 7° to an outer diameter of said intermediate length section.

13. A plug tool for forming internally helically ribbed tube, comprising a plug including a plug body for being rotatably disposed in a die orifice of a drawing die and having a central longitudinal axis, a plurality of external grooves equally spaced about said central longitudinal axis, and a plurality of external lands in alternating arrangement with said grooves, each of said plurality of grooves terminating at a forward groove end and at a rearward groove end on said plug body, each of said plurality of lands terminating at a forward land end and at a rearward land end on said plug body, said grooves extending longitudinally along said plug body at a helix angle to said central longitudinal axis and corresponding to internal helical ribs formed in tubing drawn longitudinally over and relative to said plug body in a forward direction through the die orifice as said plug body rotates within the die orifice and the tubing, each of said grooves having a cross-section normal to said groove defined by a root surface and a pair of flank surfaces extending angularly outwardly away from one another from said root surface to land surfaces of adjacent ones of said lands, said root surface having a width in said cross-section defined between first and second radii, a rearward one of said flank surfaces being angularly offset from said first radii at a first angle in said cross-section in a direction opposed to the forward direction of draw for the tubing over said plug body, and a forward one of said flank surfaces being angularly offset from said second radii at a second angle, smaller than said first angle, in said cross-section in a direction toward the forward direction of draw for the tubing over said plug body.

14. The plug tool recited in claim 13 wherein each of said land surfaces has a width and said width of said land surfaces is at least substantially the same as said width of said root surfaces.

15. The plug tool recited in claim 14 wherein said width of said root surfaces is in the range of about 3.9 mm to about 4.3 mm.

16. The plug tool recited in claim 13 wherein said first angle is about 37° and said second angle is about 16°.

17. A plug tool for forming internally helically ribbed tube, comprising a plug including a plug body for being rotatably disposed in a die orifice of a drawing die and having a central longitudinal axis, a plurality of external grooves equally spaced about said central longitudinal axis, and a plurality of external lands in alternating arrangement with said grooves, said grooves extending longitudinally along said plug body at a helix angle to said central longitudinal axis and corresponding to internal helical ribs formed in tubing drawn in a forward direction through the drawing die with said plug body disposed within the tubing, each of said grooves having a cross-section normal to said groove defined by a root surface and a pair of flank surfaces extending angularly outwardly away from one another from said root surface to land surfaces of adjacent ones of said lands, said root surface having a width in said cross-section defined between first and second radii, a rearward one of said flank surfaces being disposed at a first angle to said first radii and a forward one of said flank surfaces being disposed at a second angle, smaller than said first angle, to said second radii, wherein said helix angle is 40°, said first angle is 37° and said second angle is 16°.

18. A plug tool for forming internally helically ribbed tube, comprising a plug including a plug body for being rotatably disposed in a die orifice of a drawing die and having a central longitudinal axis, a plurality of external grooves equally spaced about said central longitudinal axis, and a plurality of external lands in alternating arrangement with said grooves, said grooves extending longitudinally alone said plug body at a helix angle to said central longitudinal axis and corresponding to internal helical ribs formed in tubing drawn in a forward direction through the drawing die with said plug body disposed within the tubing, each of said grooves having a cross-section normal to said groove defined by a root surface and a pair of flank surfaces extending angularly outwardly away from one another from said root surface to land surfaces of adjacent ones of said lands, said root surface having a width in said cross-section defined between first and second radii, a rearward one of said flank surfaces being disposed at a first angle to said first radii and a forward one of said flank surfaces being disposed at a second angle, smaller than said first angle, to said second radii, each of said land surfaces having a width, said width of said land surfaces being at least substantially the same as said width of said root surfaces, said width of said root surfaces being in the range of about 3.9 mm to about 4.3 mm, wherein said grooves have a depth and said depth of said grooves is in the range of about 1.3 mm to about 1.6 mm.

19. A plug tool for forming internally helically ribbed tube, comprising a plug including a plug body for being rotatably disposed in a die orifice of a drawing die and having a central longitudinal axis, a plurality of external grooves equally spaced about said central longitudinal axis, and a plurality of external lands in alternating arrangement with said grooves, said grooves extending longitudinally along said plug body at a helix angle to said central longitudinal axis and corresponding to internal helical ribs formed in tubing drawn in a forward direction through the drawing die with said plug body disposed within the tubing, each of said grooves having a cross-section normal to said groove defined by a root surface and a pair of flank surfaces extending angularly outwardly away from one another from said root surface to land surfaces of adjacent ones of said lands, said root surface having a width in said cross-section defined between first and second radii, a rearward one of said flank surfaces being disposed at a first angle to said first radii and a forward one of said flank surfaces being disposed at a second angle, smaller than said first angle, to said second radii, wherein said plug body is made of tool steel hardened and triple tempered to about 63RC.

20. The plug tool recited in claim 19 and further comprising a deposition of titanium nitride on said plug.

21. The plug tool recited in claim 19 and further comprising a coating of mono-molecular diamond on said plug.

22. The plug tool recited in claim 19 and further comprising a coating of titanium nickel carbide on said plug.

23. A plug tool for forming internally helically ribbed tube, comprising a plug including a plug body for being rotatably disposed in a die orifice of a drawing die and having a central longitudinal axis, a forward end, a rearward end, a plurality of external grooves equally spaced about said central longitudinal axis, and a plurality of external lands in alternating arrangement with said grooves, said grooves extending longitudinally along said plug body at a helix angle to said central longitudinal axis and corresponding to internal helical ribs formed in tubing drawn longitudinally over and relative to said plug body from said rearward end of said plug body toward said forward end of said plug body in a forward direction through the die orifice as said plug body rotates within the die orifice and the tubing, each of said grooves having an asymmetrical cross-section normal to said groove defined by a root surface, a rearward flank surface extending angularly outwardly from said root surface at a first radial angle toward said rearward end of said plug body and a forward flank surface extending angularly outwardly from said root surface at a second radial angle, less than said first radial angle, and in a direction opposite said rearward flank surface;

an elongate shaft extending rearwardly from said plug body for being received in the tubing being drawn through the die orifice and having a forward end for being coupled to said plug body; and a connector for coupling said plug body to said forward end of said shaft for rotation of said shaft as one with said plug body when said plug body rotates within the die orifice and the tubing about said central longitudinal axis.

24. The plug tool recited in claim 23 wherein said shaft comprises an axial threaded passage therein at said forward end of said shaft and said connector comprises an externally threaded extension extending coaxially from said rearward end of said plug body for threaded engagement in said passage.

25. The plug tool recited in claim 24 wherein said extension is integral and unitary with said plug body.

26. The plug tool recited in claim 23 wherein said shaft comprises a back-bar having a forward end defining said forward end of said shaft.

27. The plug tool recited in claim 23 wherein said shaft comprises a back-bar and an adapter connected to said back-bar, said adapter having a forward end defining said forward end of said shaft.

28. The plug tool recited in claim 27 wherein said back-bar has an outer diameter to fit within the tubing and said adapter has an outer diameter to fit more closely within the tubing than said outer diameter of said back-bar.

29. The plug tool recited in claim 23 and further comprising a guide tube receiving said elongate shaft, said guide tube having an inner diameter to accommodate the tubing in which said shaft is disposed.

30. The plug tool recited in claim 23 wherein said first radial angle is about 37° and said second radial angle is about 16°.

31. A plug tool for forming internally helically ribbed tube, comprising a plug including a plug body for being rotatably disposed in a die orifice of a drawing die and having a central longitudinal axis, a plurality of external grooves equally spaced about said central longitudinal axis, and a plurality of external lands in alternating arrangement with said grooves, said grooves extending longitudinally alone said plug body at a helix angle to said central longitudinal axis and corresponding to internal helical ribs formed in tubing drawn in a forward direction through the drawing die with said plug body disposed within the tubing, each of said grooves having an asymmetrical cross-section normal to said groove defined by a root surface, a rearward flank surface extending angularly outwardly from said root surface at a first radial angle and a forward flank surface extending angularly outwardly from said root surface at a second radial angle, less than said first radial angle, and in a direction opposite said rearward flank surface;

an elongate shaft for being received in the tubing drawn through the drawing die and having a forward end for being coupled to said plug body; and a connector for coupling said plug body to said forward end of said shaft for rotation of said shaft as one with said plug body when said plug body rotates in the die orifice about said central longitudinal axis, wherein said plug body has an axial bore extending entirely therethrough and said connector comprises a head and a shank extending from said head, said shank having an externally threaded portion, said shank being insertable in said bore with said externally threaded portion extended coaxially from said rearward end of said plug body to define said extension.

32. The plug tool recited in claim 31 wherein said head defines a forward abutment at a forward end of said plug body and said forward end of said shaft defines a rearward abutment at said rearward end of said plug body and said plug body is confined in the axial direction between said forward and rearward abutments.

33. The plug tool recited in claim 31 wherein said connector comprises a socket head cap screw.

34. A plug tool for forming internally helically ribbed tube, comprising a plug including a plug body for being rotatably disposed in a die orifice of a drawing die and having a central longitudinal axis, a plurality of external grooves equally spaced about said central longitudinal axis, and a plurality of external lands in alternating arrangement with said grooves, said plug body being constrained against longitudinal movement in the drawing die, said grooves extending longitudinally along said plug body at a helix angle to said central longitudinal axis and closely corresponding to internal helical ribs formed in tubing being drawn longitudinally over and relative to said plug body in a forward direction through the die orifice as said plug body rotates within the die orifice and the tubing, each of said grooves having an asymmetrical cross-section normal to said groove defined by a root surface and a pair of flank surfaces extending from said root surface to land surfaces of adjacent ones of said lands, each of said grooves having a width at said root surface and between said flank surfaces, each of said lands having a width substantially equal to said width of said grooves, each of said pair of flank surfaces comprising a rearward flank surface angled from said root surface in a direction opposed to the forward direction of draw for the tubing over said plug body and a forward flank surface angled from said root surface toward the forward direction of draw for the tubing over said plug body, said forward flank surfaces being steeper than said rearward flank surfaces.

35. The plug tool recited in claim 34 wherein said width of each of said grooves is defined between radii of said central longitudinal axis.

36. The plug tool recited in claim 34 wherein said rearward flank surfaces define an angle of about 37° with one of said radii and said forward flank surfaces define an angle of about 16° with the other of said radii.

37. A plug tool for forming internally helically ribbed tube, comprising a plug including a plug body for being rotatably disposed in a die orifice of a drawing die and having a central longitudinal axis, a plurality of external grooves equally spaced about said central longitudinal axis, and a plurality of external lands in alternating arrangement with said grooves, said grooves extending longitudinally along said plug body at a helix angle to said central longitudinal axis and closely corresponding to internal helical ribs formed in tubing being drawn in a forward direction through the drawing die with said plug body disposed within the tubing, each of said grooves having an asymmetrical cross-section normal to said groove defined by a root surface and a pair of flank surfaces extending from said root surface to land surfaces of adjacent ones of said lands, each of said grooves having a width at said root surface and between said flank surfaces, each of said lands having a width substantially equal to said width of said grooves, said width of each of said grooves being defined between radii of said central longitudinal axis, wherein each of said grooves has a rearward one of said flank surfaces defining an angle of 37° with one of said radii and a forward one of said flank surfaces defining an angle of 16° with the other of said radii.

38. A method of producing internally ribbed tube, comprising the steps of drawing a length of plain tubing longitudinally in a forward direction over a longitudinally constrained plug body rotatably disposed in a die orifice of a drawing die and having a plurality of external grooves at equally spaced locations about a central longitudinal axis of the plug body and extending longitudinally at a helix angle to the central longitudinal axis in alternating arrangement with a like plurality of external lands, wherein each groove has a root surface and a pair of forward and rearward flank surfaces extending from the root surface at different radial angles in opposite directions from one another to the land surfaces of a pair of adjacent ones of the lands, wherein the radial angle of the forward flank surfaces extends toward the forward direction of draw for the tubing over the plug body and is less than the radial angle of the rearward flank surfaces such that the forward flank surfaces are steeper than the rearward flank surfaces; and constricting the tubing in the drawing die to force an internal surface of the tubing into the external grooves of the plug body to form a plurality of continuous helical ribs extending longitudinally along the internal surface in correspondence to the external grooves.

39. The method recited in claim 38 wherein said step of drawing is a second drawing step and further including, prior to said second drawing step, the steps of drawing the tubing over a plain plug in a first drawing step and annealing the tubing subsequent to said first drawing step and prior to said second drawing step.

40. The method recited in claim 39 and further comprising, subsequent to said second drawing step, the steps of heat treating the tubing, straightening the tubing and cutting the tubing into tubes of desired length.

41. The method recited in claim 40 and further including the steps of subjecting the tubing to wet preparation prior to said first drawing step and subsequent to said first drawing step and prior to said second drawing step, and removing points and tails from the tubing subsequent to said second drawing step and prior to said heat treating step.

42. The method recited in claim 41 and further including, subsequent to said step of cutting, the steps of applying corrosion protection to the tubes, capping the ends of the tubes, bundling the tubes, documenting the tubes, labeling the tubes, storing the tubes and shipping the tubes to a designated site.

43. The method recited in claim 41 wherein said step of subjecting the tubing to wet preparation includes the steps of chemically descaling the tubing, passivating the surface of the tubing, soaping the tubing and drying the tubing.

44. The method recited in claim 43 wherein said step of chemically descaling comprises applying a sulphuric acid solution to the tubing.

45. The method recited in claim 43 wherein said step of passivating comprises applying a phosphate solution to the tubing.

* * * * *